US006764971B2

(12) United States Patent
Kelly et al.

(10) Patent No.: US 6,764,971 B2
(45) Date of Patent: Jul. 20, 2004

(54) IMAGED NONWOVEN FIRE-RETARDANT FIBER BLENDS AND PROCESS FOR MAKING SAME

(75) Inventors: Karl Dewayne Kelly, Holly Springs, NC (US); Thomas A. Hill, Raleigh, NC (US); Francois Lapierre, Brossard (CA); Spiro De Luca, Laval (CA); Sergio Diaz de Leon, Clayton, NC (US)

(73) Assignee: Polymer Group, Inc., North Charleston, SC (US)

( * ) Notice: Subject to any disclaimer, the term of this patent is extended or adjusted under 35 U.S.C. 154(b) by 225 days.

(21) Appl. No.: 09/798,304

(22) Filed: Mar. 2, 2001

(65) Prior Publication Data

US 2002/0004348 A1 Jan. 10, 2002

Related U.S. Application Data

(60) Provisional application No. 60/186,406, filed on Mar. 2, 2000.

(51) Int. Cl.[7] ..... D04H 1/46; D04H 1/42; B32B 3/00; B27N 9/00

(52) U.S. Cl. ..... 442/408; 442/414; 442/415; 428/172; 428/920; 428/921; 28/104

(58) Field of Search ..... 442/408, 414, 442/415; 428/920, 921, 88, 89, 172; 28/104

(56) References Cited

U.S. PATENT DOCUMENTS 5,578,368 A * 11/1996 Forsten et al. ..... 442/408
5,630,261 A * 5/1997 Beasley, Jr. ..... 28/104
5,806,155 A * 9/1998 Malaney et al. ..... 28/104
5,822,833 A * 10/1998 James et al. ..... 442/408
6,407,019 B1 * 6/2002 Schafer et al. ..... 442/408

OTHER PUBLICATIONS

Ilg et al. EP 729526 Derwent English Abstract. Sep. 4, 1996.*

* cited by examiner

*Primary Examiner*—Sheryl A. Juska
*Assistant Examiner*—Jenna-Leigh Befumo
(74) *Attorney, Agent, or Firm*—Wood, Phillips, Katz, Clark & Mortimer

(57) ABSTRACT

The present invention is directed to a durable and imaged flame-retardant nonwoven fabric that can be used for flame-retardant apparel and other related applications. The fabric is formed by providing a precursor web consisting of a blend of melamine fibers and aramid fibers. The precursor web is hydroentangled on a three-dimensional image transfer device for formation of the fabric. The resultant fabric provides desirable air permeability and Thermal Protective Properties.

7 Claims, 4 Drawing Sheets

SECTION A-A

FIG. 4A
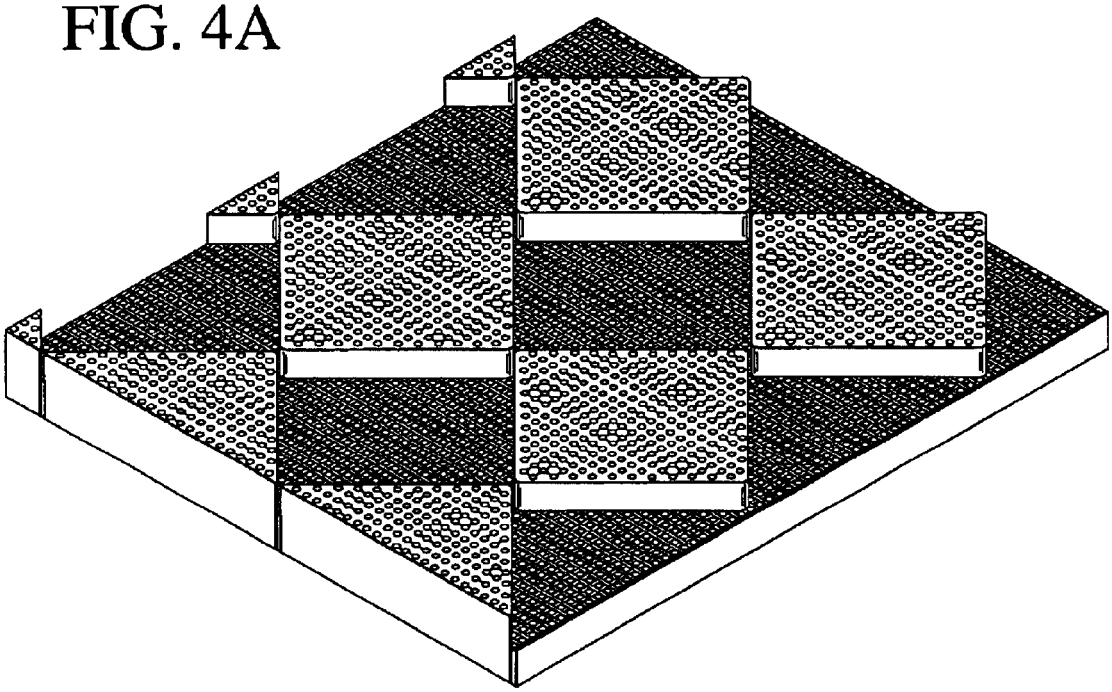
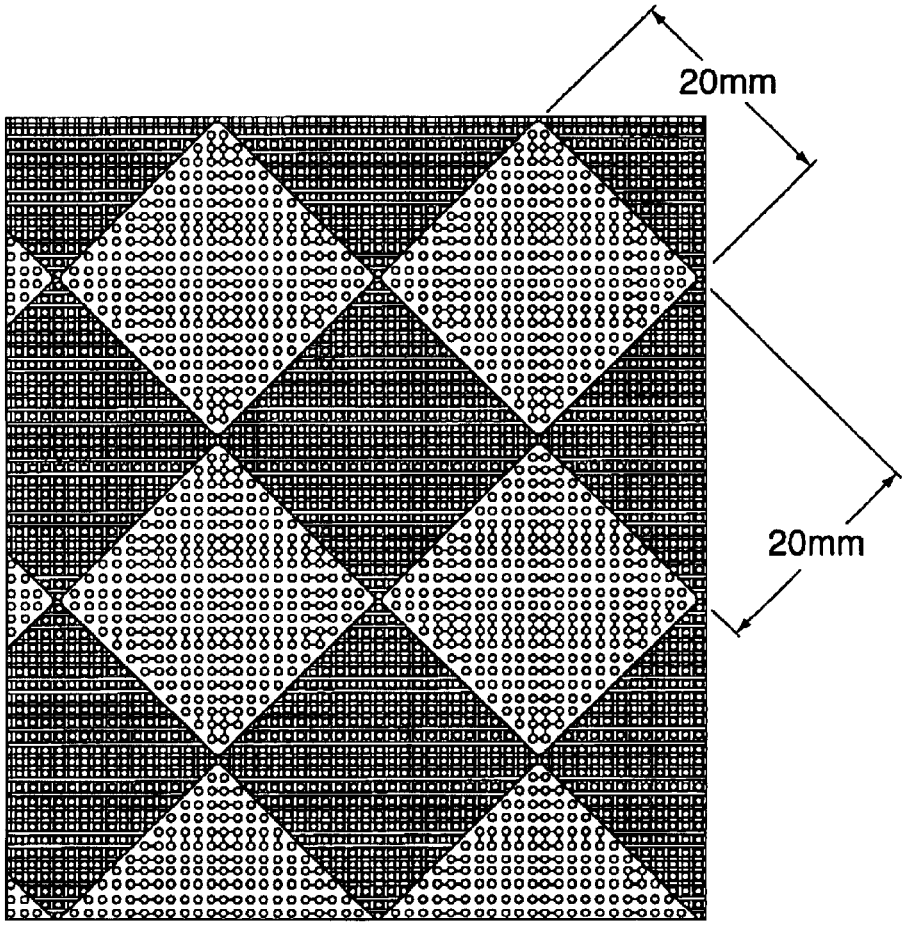
FIG. 4B

IMAGED NONWOVEN FIRE-RETARDANT FIBER BLENDS AND PROCESS FOR MAKING SAME

CROSS-REFERENCE TO RELATED APPLICATION

This application claims the benefit of Provisional Application Serial No. 60/186,406, filed Mar. 2, 2000.

BACKGROUND OF THE INVENTION

This invention relates to a durable and imaged flame-retardant nonwoven fabric that can be used for flame-retardant apparel and other related applications. There are numerous flame-retardant fibers commercially available. E. I du Pont de Nemours and Company provides flame-retardant aramid fibers sold under the trade names of NOMEX® and KEVLAR®. NOMEX® materials were developed for applications requiring dimensional stability and excellent heat resistance, and which do not flow or melt upon heating. Decomposition and charring does not proceed at a significant rate until well over 350° C. without melting. NOMEX® materials in fibrous form have been used in protective apparel and similar applications, and can be processed by conventional textile technology. Heretofore, comparable flame-retardant nonwoven fabrics have been expensive to manufacture, and have not been susceptible of imaging by high pressure water jet entangling. Specific examples of prior art materials are set forth below.

U.S. Pat. No. 4,199,642 discloses a flame resistant fiberfill batt consisting of polyester fiberfill and synthetic organic filamentary materials, including poly(m-phenylene isophthalamide) blended therewith that maintains its physical integrity when exposed to the flame from a burning match.

U.S. Pat. No. 4,463,465 discloses an aircraft seat cushion including a highly heat-sensitive urethane foam covered by a flexible matrix, which may comprise a NOMEX® fabric. A further gas barrier layer may also be provided, which can also be a NOMEX® fabric.

A wet-type survival suit is disclosed in U.S. Pat. No. 4,547,904, including inner and outer NOMEX® layers, which provide maximum protection against fire.

A fire-retardant panel is disclosed in U.S. Pat. No. 4,726,987 and No. 4,780,359 which includes one or more layers of NOMEX® fiber that may be combined with adjacent fibrous layers by needle punching.

U.S. Pat. No. 4,748,065 discloses a flame resistant fabric, wherein a spunlaced fabric formed of fibers, such as NOMEX®, is brush-coated with an aqueous slurry containing activated carbon particles. The resulting fabric was subsequently dried and softened by crepeing. Laminates, including spunlaced outer layers of NOMEX® fibers, are also disclosed.

A fire-blocking textile fabric is disclosed in U.S. Pat. No. 4,750,443, which includes three to seven nonwoven layers that are hydraulically needled to one another. Each layer may be formed of NOMEX® fibers; however, an outer woven layer may be provided to impart dimensional stability and abrasion resistance.

U.S. Pat. No. 4,937,136 discloses a laminate for use in fire protective garments. The laminate includes a nonwoven fabric comprised of a blend of wool and synthetic fibers capable of high temperature performance, such as NOMEX®. The laminate includes an outer shell, which may also be formed of NOMEX® and an intermediate moisture barrier layer.

An animal bed cover is disclosed in U.S. Pat. No. 5,226,384, which is formed of an aramid fabric sheet, e.g. KEVLAR® with a polyester fabric sheet laminated to it.

In U.S. Pat. No. 5,252,386, a fire retardant entangled polyester nonwoven fabric is disclosed. The patent states that the fabric has balanced tensile strength properties in the cross- and machine-directions and improved fire retardant properties by cross-stretching the entangled fabric, after the fabric has been wetted with an aqueous-based fire retardant composition, and drying the wetted fabric while maintaining it in its stretched state.

U.S. Pat. No. 5,279,879 discloses a flame-retarding nonwoven fabric formed of partially graphitized polyacrylonitrile fibers that are bonded by water jet needling. The fabric may be reinforced by warp-wise and weft-wise threads, and the fabric may be combined with a decorative fabric/material by adhesive securement.

U.S. Pat. No. 5,475,903 discloses a fabric that is formed by carding synthetic fibers, such as polyester fibers, cross-lapping the carded web to orient the fibers in the cross-direction, drafting the cross-lapped web to reorient certain of the fibers in the machine-direction, applying unbonded wood fibers to the top of the drafted web, and hydroentangling the resulting web to entangle the wood fibers with those of the polyester drafted web. A liquid fire-retardant composition is then applied to the hydroentangled web.

In U.S. Pat. No. 5,578,368, a fire-resistant material is disclosed, which includes a fiberfill batt, that may comprise polyester fibers, and a fire-resistant aramid fibrous layer like NOMEX®, at one, or both, faces of the batt. The aramid fiber layer may be joined to the fiberfill batt by hydroentangling.

U.S. Pat. No. 5,609,950 and No. 5,766,746 disclose a flame-retardant nonwoven fabric wherein fleece, including cellulose fibers having a flame-retardant containing phosphorus, is bonded by water jet entanglement.

In order to provide adequate protection to the skin from burn damage by heat and/or flame, currently available fabrics for flame retardant clothing rely upon high basis weights and bulks. A practical consequence of extended wear of articles made of these heavy fabrics is fatigue and potential dehydration due to poor air circulation. Blends of melamine fibers (BASF Corporation under the trade name of BASOFIL) with varying ratios of aramid fibers, as is disclosed in U.S. Pat. No. 5,560,990, hereby incorporated by reference, are known. It has been discovered that when a melamine/aramid fiber blend is hydroentangled and a 3-dimensional image imparted, thermal protection to the skin at lower basis weights are maximized, thereby providing significantly improved wearer comfort and safety.

SUMMARY OF THE INVENTION

The fabric of the present invention is a hydroentangled, imaged nonwoven fabric formed from a blend of melamine and aramid fibers. While the heat and flame-resistant properties of aramid fibers are well understood and appreciated, fabrics produced using these aramid fibers are known to be heavy in weight and low in air permeability. When converted into flame retardant apparel, fatigue due to heat and dehydration in instances of extended wear, are commonplace.

It has been discovered that the use of melamine fibers, when blended with aramid fibers in relative ratios of between 45 weight percent and 55 weight percent, and preferably about 50 weight percent, of the melamine fiber, provides improvement in Thermal Protective Properties (TPP). In a preferred embodiment, a carded staple fiber blend is hydroentangled by the use of high-pressure water jets followed by imaging on a three-dimensional surface to provide a fabric with a basis weight range of between 65 grams per square meter and 150 grams per square meter, a resultant air permeability greater than 65 CFM per gram fabric weight per cubic centimeter and a TPP rating greater than 11.4 cal-sec per square centimeter.

BRIEF DESCRIPTION OF THE DRAWING

FIGS. 2*a* through 4*b* are schematic representations of preferred three-dimensional imaging surfaces;

DESCRIPTION OF PREFERRED EMBODIMENTS

Figure 1:
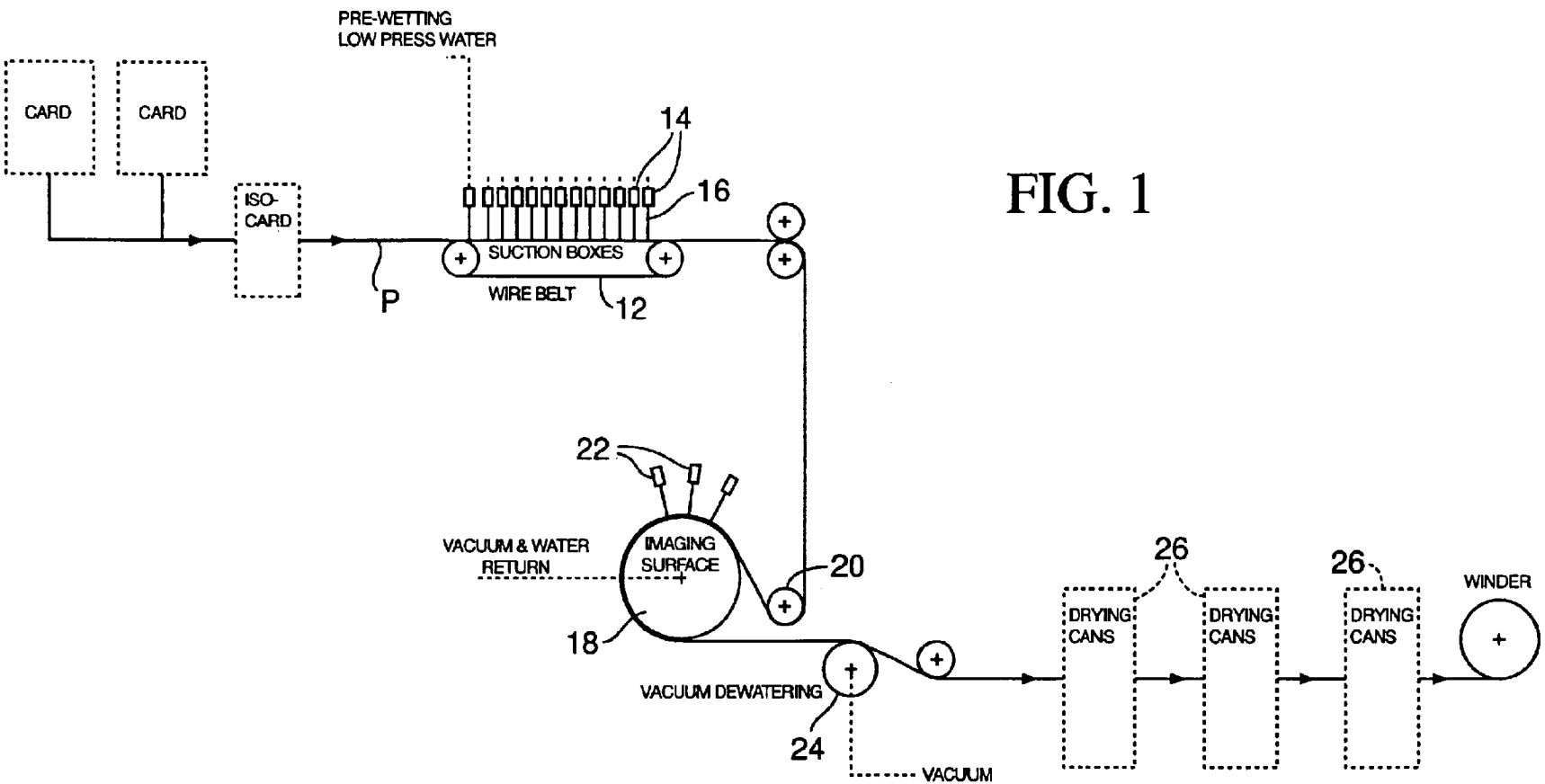
FIG. 1 is a schematic representation of a production line upon which the process of the present invention is practiced and the fabric of the present invention is produced.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

With reference to FIG. 1, therein is illustrated an apparatus for practicing the present method for forming a nonwoven fabric. The fabric is formed from a fibrous matrix which comprises a blend of melamine and aramid staple length. The fibrous matrix is preferably carded and subsequently air-randomized to form a precursor web, designated P.

FIG. 1 illustrates a hydroentangling apparatus for forming nonwoven fabrics in accordance with the present invention. The apparatus includes a foraminous forming surface in the form of belt 12 upon which the precursor web P is positioned for pre-entangling. Precursor web P is then sequentially passed under entangling manifolds 14, whereby the precursor web P is subjected to high pressure water jets 16. This process is one well-known to those skilled in the art and is generally as taught by Evans in U.S. Pat. No. 3,485,706, incorporated herein by reference.

The entangling apparatus of FIG. 1 further includes an imaging and patterning drum 18 comprising a three-dimensional image transfer device for effecting imaging and patterning of the now-entangled precursor web. After pre-entangling, the precursor web is then trained over a guide roller 20 and directed to an image transfer device 18, where a three-dimensional image is imparted into the fabric. The web of blended fibers is juxtaposed to image transfer device 18, and high pressure water from manifolds 22 is directed against the outwardly facing surface from jets spaced radially outwardly of image transfer device 19. Image transfer device 18 and manifolds 22 may be formed, and operated, in accordance with the teachings of commonly assigned U.S. Pat. Nos. 5,098,764, 5,244,711, 5,822,823, and 5,827,597, the disclosures of which are expressly incorporated herein by this reference. It is presently preferred that the precursor web P be given a three-dimensional image suitable to provide the desired air permeability of the final imaged fabric. The entangled fabric can then be vacuum dewatered at 24, and dried on drying cans 26.

EXAMPLES 1–6

EXAMPLE 1

Using a forming apparatus as illustrated in FIG. 1, a nonwoven fabric was made in accordance with the present invention by providing a precursor web comprising a blend of 50 weight percent melamine fibers and 50 weight percent aramid fibers. The web had a basis weight of approximately 85 grams per square meter.

The fabric comprised BASF BASOFIL (assorted denier and staple length of between 0.5 and 4.0 inches) and Du Pont NOMEX® (1.5 denier and 2 inch staple length). Prior to patterning and imaging of the precursor web, the web was pre-entangled by a series of entangling manifolds such as diagrammatically illustrated in FIG. 1. FIG. 1 illustrates disposition of precursor web P on a foraminous forming surface in the form of belt 10, with the web acted upon by sequential entangling manifolds 14. In the present examples, each of the entangling manifolds included 127-micron orifices spaced at 40 per inch, with four of the manifolds successively operated at 100, 300, 600, and 800 pounds per square inch. The entangling apparatus of FIG. 1 further includes an imaging and patterning drum 18 comprising a three-dimensional image transfer device for effecting imaging and patterning of the now-entangled precursor web. The entangling apparatus includes three entangling manifolds 22 which act in cooperation with the three-dimensional image transfer device of drum 18 to effect patterning of the fabric. In the present example, the entangling manifolds 22 were each operated at 2500 pounds per square inch, 127-micron orifices spaced at 40 per inch, and at a line speed of 30 feet per minute.

Figure 2A:
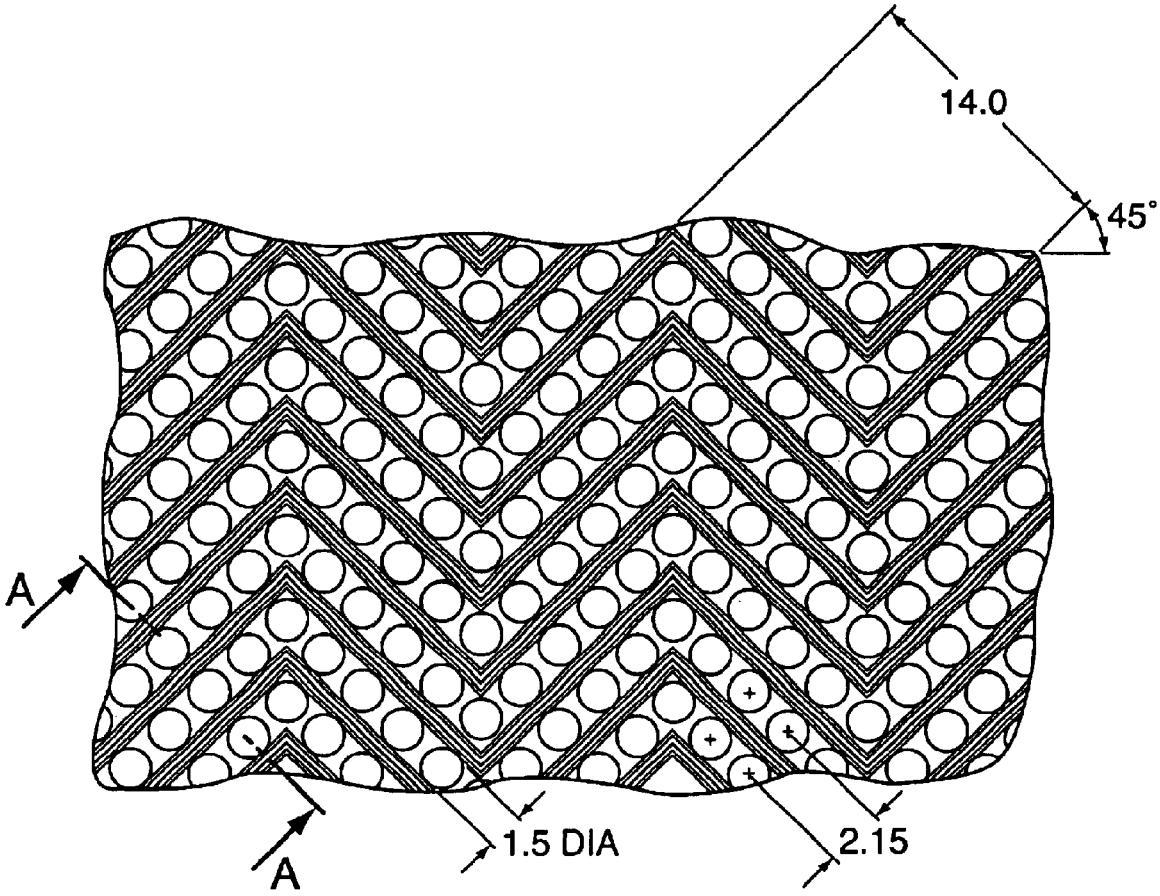
Figure 2B:
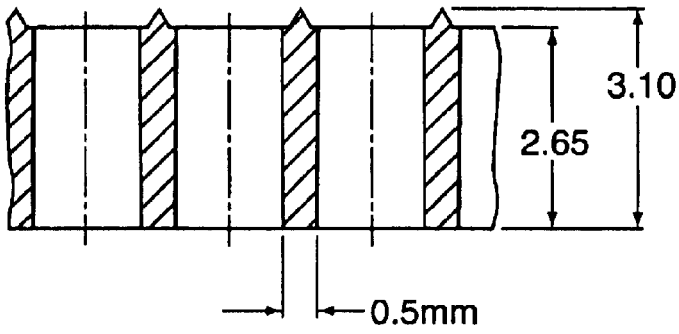

The three-dimensional image transfer device of drum 18 was configured as a so-called "herringbone", as illustrated in FIGS. 2*a* and 2*b*.

A resultant fabric had a basis weight of 91.1 grams per square meter, a bulk of 0.031 inches, and a machine-direction strip tensile strength of 62.3 grams per centimeter as measured on an INSTRON Testing Device. Air permeability was 281.1 CFM as measured by ASTM D737. The TPP (thermal protection property) for this material, as measured by the test protocol specified in the NFPA 1971, 1997 Ed. (section 6,10), was 11.8.

For this material, a value of air permeability to mass/volume of 79.6 CFM/gram/cc was obtained.

EXAMPLE 2

A fabric as made in the manner described in EXAMPLE 1, whereby in the alternative the three-dimensional image transfer device of drum 18 was configured as a so-called 33×28, a rectilinear pyramidal forming pattern having 33 lines per inch by 28 lines per inch configured in accordance with FIG. 13 of U.S. Pat. No. 5,098,764, except mid-pyramid drain holes are omitted. Pyramid height is approximately 1.5 mm, with the long axis of each pyramid being oriented in the machine direction.

A resultant fabric had a basis weight of 89.1 grams per square meter, a bulk of 0.030 inches, a machine-direction strip tensile strength of 57.9 grams per centimeter, an air permeability of 283.9 CFM and a TPP of 11.5.

For this material, a value of air permeability to mass/volume of 80.9 CFM/gram/cc was obtained.

EXAMPLE 3

A fabric as made in the manner described in EXAMPLE 1, whereby in the alternative the three-dimensional image transfer device of drum 18 was configured as a so-called 20×20, a rectilinear pyramidal forming pattern having 20 lines per inch by 20 lines per inch configured in accordance with FIG. 13 of U.S. Pat. No. 5,098,764, except mid-pyramid drain holes are omitted. Pyramid height is 0.025 inches, with the drain holes at the corners of each pyramid having a 0.02 inch diameter. Drainage area is 12.5% of the surface area.

A resultant fabric had a basis weight of 91.9 grams per square meter, a bulk of 0.030 inches, a machine-direction strip tensile strength of 62.0 grams per centimeter, an air permeability of 246.8 CFM and a TPP of 11.8.

For this material, a value of air permeability to mass/volume of 68.2 CFM/gram/cc was obtained.

EXAMPLE 4

Figure 3A:
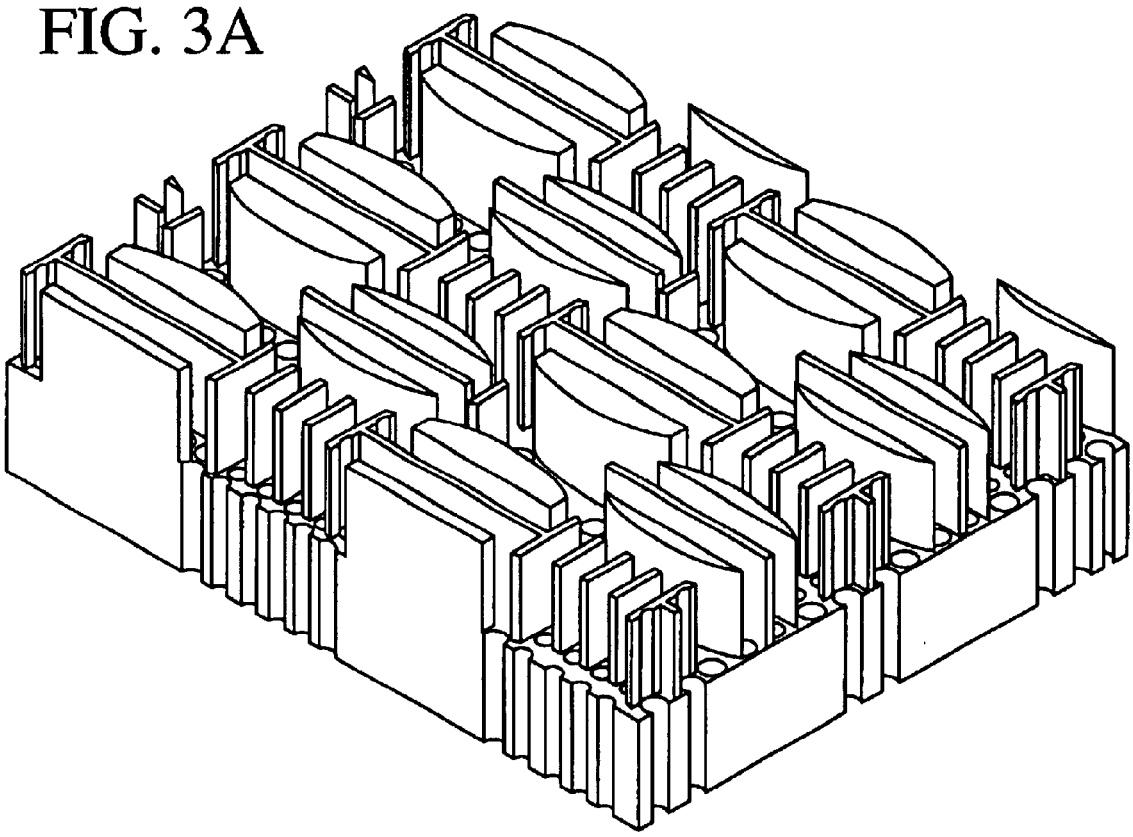
Figure 3B:
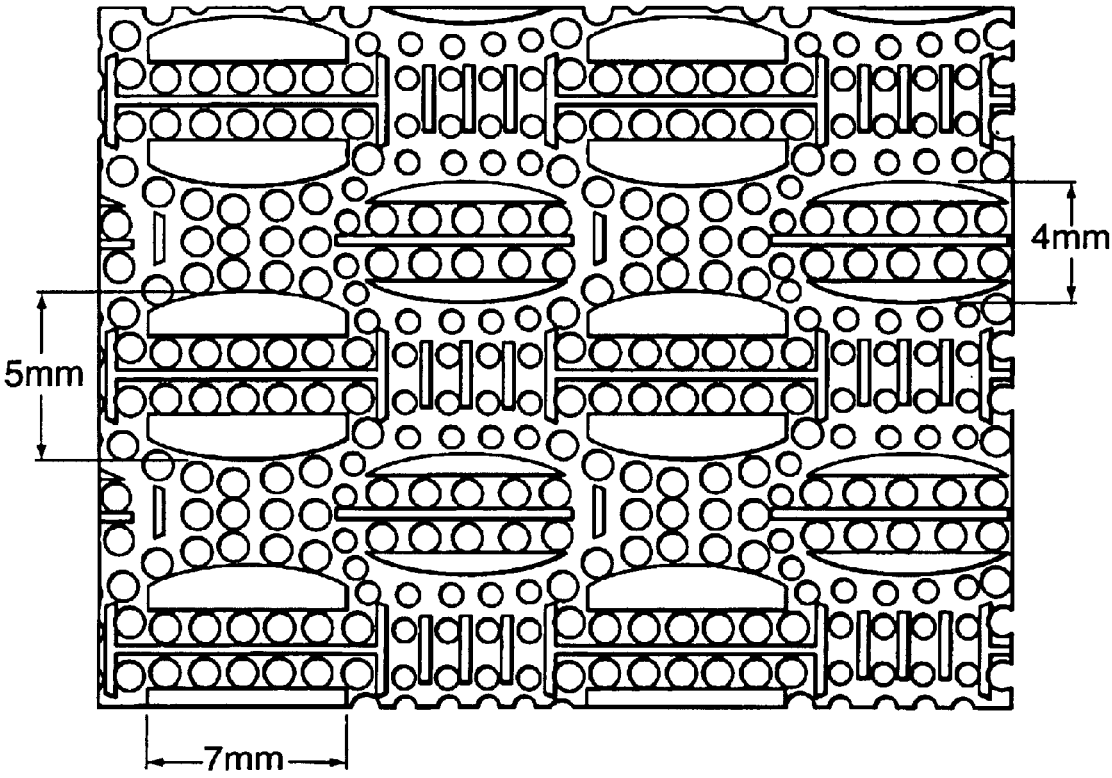

A fabric as made in the manner described in EXAMPLE 1, whereby in the alternative the three-dimensional image transfer device of drum 18 was configured as a so-called "pique", as illustrated in FIGS. 3*a* and 3*b*.

A resultant fabric had a basis weight of 87.2 grams per square meter, a bulk of 0.030 inches, a machine-direction strip tensile strength of 60.0 grams per centimeter, an air permeability of 241.5 CFM and a TPP of 11.9.

For this material, a value of air permeability to mass/volume of 70.3 CFM/gram/cc was obtained.

EXAMPLE 5

A fabric as made in the manner described in EXAMPLE 1, whereby in the alternative the three-dimensional image transfer device of drum 18 was configured as a so-called "diamond", as illustrated in FIGS. 4*a* and 4*b*.

A resultant fabric had a basis weight of 88.5 grams per square meter, a bulk of 0.025 inches, a machine-direction strip tensile strength of 54.5 grams per centimeter, an air permeability of 241.5 CFM and a TPP of 11.5.

For this material, a value of air permeability to mass/volume of 69.3 CFM/gram/cc was obtained.

COMPARATIVE EXAMPLE 6

A commercially available fabric was obtained in the form of Du Pont E89, type P-27.

Testing of this fabric under identical conditions as above gave results of a basis weight of 101.6 grams per square meter, a bulk of 0.028 inches, a machine-direction strip tensile strength of 61.2 grams per centimeter, an air permeability of 181.0 CFM and a TPP of 11.0.

For this material, a value of air permeability to mass/volume of 45.2 CFM/gram/cc was obtained.

Table 1 sets forth test data for the above-described fabrics.

TABLE 1

| | DuPont E 89/P-27 | Modified Twill | Plain Weave | Rip-stop | Pique | Diamond |
|---|---|---|---|---|---|---|
| Mass per Unit Area (gsm) | 101.6 | 91.1 | 89.1 | 91.9 | 87.2 | 88.5 |
| Mass per Unit Volume (cc) | 4.0 | 3.6 | 3.5 | 3.6 | 3.4 | 3.5 |
| Bulk (mils) | 28.3 | 31 | 30 | 30 | 30 | 25 |
| Tensile Strength - MD | 61.2 | 62.3 | 57.9 | 62 | 60 | 54.5 |
| Tensile Strength - CD | 62.3 | 26.1 | 26.8 | 28.2 | 26.8 | 28.9 |
| TPP - Single Layer (SD< | 11.0 | 11.8 | 11.5 | 11.8 | 11.9 | 11.5 |

TABLE 1-continued

| | DuPont E 89/P-27 | Modified Twill | Plain Weave | Rip-stop | Pique | Diamond |
|---|---|---|---|---|---|---|
| Flame Resistance - Vertical test Afterglow MD (sec) | 4.0 | 2.0 | 2.0 | 2.0 | 2.0 | 2.0 |
| Flame resistance - Vertical test Afterglow CD (sec) | 3.5 | 2.0 | 1.0 | 2.0 | 1.5 | 1.0 |
| Normalized Air Permeability (CFM/gram/cc) | 45.2 | 79.6 | 80.9 | 68.2 | 70.3 | 69.3 |

What is claimed is:

1. An entangled nonwoven fabric with thermal protective properties formed by a process comprising the steps of:

providing a precursor web consisting of a fiber blend of melamine fibers and aramid fibers, said blend comprising between 45 weight percent and 55 weight percent melamine fibers, entangling said precursor web with high pressure water jets to form a pre-entangled precursor web, directing said pre-entangled precursor web onto a three-dimensional image transfer device having a three-dimensional imaging surface, and applying water under high pressure to impart an image of said imaging surface to the pre-entangled precursor web to form said entangled nonwoven fabric, said entangled nonwoven fabric having an air permeability rating of greater than 65 CFM per gram of fabric weight per cubic centimeter and a thermal protective property rating of at least 11.4 calorie-seconds per square centimeter.

2. A fabric according to claim 1 having a fiber blend comprising about 50 weight percent melamine fibers.

3. A fabric according to claim 1 having a having a basis weight in the range of 65 gsm to 150 gsm.

4. A thermal protection fabric comprised of a precursor web consisting of a blend of melamine fibers and aramid fibers, the precursor web being pre-entangled with high pressure water jets, and thereafter directed onto a imaging member having a three-dimensional imaging surface, with water under high pressure applied thereto to impart an image of said imaging surface to the pre-entangled precursor web such that the final resultant fabric has a fiber blend comprising about 50 weight percent melamine fibers, a basis weight in the range of 65 gsm to 150 gsm, an air permeability rating of greater than 65 CFM per gram of fabric weight per cubic centimeter and a thermal protective property rating of at least 11.4 calorie-seconds per square centimeter.

5. A fabric of claim 4, wherein said fabric is configured as an article of flame retardant apparel.

6. A fabric of claim 4, wherein said fabric is configured as a thermal protective blankets.

7. A fabric of claim 4, wherein said fabric is configured as one of a drapery or drapery lining.

* * * * *